US007331619B2

(12) United States Patent
Lewis

(10) Patent No.: US 7,331,619 B2
(45) Date of Patent: Feb. 19, 2008

(54) LATCH-SPRING ASSEMBLY FOR ENCLOSURES

(75) Inventor: Jeffrey M. Lewis, Maynard, MA (US)

(73) Assignee: EMC Corporation, Hopkinton, MA (US)

( * ) Notice: Subject to any disclaimer, the term of this patent is extended or adjusted under 35 U.S.C. 154(b) by 99 days.

(21) Appl. No.: 11/158,591

(22) Filed: Jun. 22, 2005

(65) Prior Publication Data

US 2006/0290146 A1 Dec. 28, 2006

(51) Int. Cl.
*E05B 3/00* (2006.01)

(52) U.S. Cl. ..... 292/336.3; 292/353; 292/DIG. 53

(58) Field of Classification Search ..... 292/336.3, 292/347, 348, 316, 318, 319, 323, 329, 330, 292/DIG. 53, 353
See application file for complete search history.

(56) References Cited

U.S. PATENT DOCUMENTS 1,943,585 A * 1/1934 Cummins et al. ..... 220/759
2,227,569 A * 1/1941 Brooks ..... 292/310
2,992,034 A * 7/1961 Wenk, Jr. ..... 292/310
4,603,453 A * 8/1986 Yokoyama ..... 70/57.1
4,827,567 A * 5/1989 Beach ..... 16/422
2001/0042281 A1* 11/2001 Forsline ..... 15/245.1
2003/0108300 A1* 6/2003 Walker et al. ..... 385/53

* cited by examiner

*Primary Examiner*—Gary Estremsky
(74) *Attorney, Agent, or Firm*—Guerin & Rodriguez, LLP; Michael A. Rodriguez

(57) ABSTRACT

A latch-spring assembly has a handle with prongs extending from a finger-grip portion. One prong has a circumferential groove. A leaf spring has an anchor portion for attachment to a subassembly wall and a spring portion flexibly coupled to the anchor portion. The spring portion has a latching tab extending from one side and cylindrical portions. The prongs pass through openings in the subassembly wall to enter the cylindrical portions. One cylindrical portion has a compressible region, which is compressed within the groove of the one prong to secure the handle to the leaf spring. The latching tab extends through an opening in the sidewall when the leaf spring is attached to a subassembly sidewall. When the subassembly enters an enclosure, the latching tab engages a latch-receiving mechanism in the enclosure. Deflecting the handle laterally disengages the latching tab from the latch-receiving mechanism, thus releasing the subassembly from the enclosure.

17 Claims, 8 Drawing Sheets

LATCH-SPRING ASSEMBLY FOR ENCLOSURES

FIELD OF THE INVENTION

The invention relates generally to latch assemblies for enclosures. More particularly, the invention relates to a latch assembly for securing a subassembly within an enclosure and for providing a handle to remove the subassembly from the enclosure.

BACKGROUND

Electronic equipment enclosures typically employ latch mechanisms to restrain removable electrical subassemblies installed therein. Various types of latch mechanisms currently exist for securing subassemblies within an enclosure. Some latch mechanisms are spring-loaded, that is, when a user disengages a spring-latch, the subassembly partially ejects from the enclosure; other latch mechanisms are not, and the subassembly scarcely moves, if at all, when the latch mechanism becomes undone. Often, the subassembly also has a handle upon which a user can pull in order to extract the disengaged subassembly from the enclosure. Aesthetics, cost, ease of installation, size, and EMI (electromagnetic interference) shielding are some important considerations in the design of a latch mechanism.

SUMMARY

In one aspect, the invention features an apparatus having a handle with a grip portion and with a prong extending from the grip portion. The prong has an end and a groove formed near the end. The apparatus also has a leaf spring with a latching tab extending from a side thereof and a prong receptacle with a bore extending therethrough that closely receives the prong of the handle. The prong receptacle has a compressible region, wherein the compressible region is compressed within the groove of the prong to secure the handle to the leaf spring.

In another aspect, the invention features an apparatus, comprising a handle and a leaf spring. The handle has first and second prongs extending approximately parallel to each other from a finger-grip portion. The first prong has an end and a groove formed near the end. The leaf spring has an anchor portion for securing the leaf spring to a surface and a spring portion flexibly coupled at one end of the anchor portion. The spring portion has a first side with a latching tab extending therefrom and an opposite side with a first receptacle closely receiving the first prong of the handle and a second receptacle closely receiving the second prong of the handle. The first receptacle has a compressible region, wherein the compressible region is compressed within the groove of the first prong to secure the handle to the leaf spring.

In still another aspect, the invention features a method for attaching a latch-spring assembly to a subassembly. A handle and a leaf spring are positioned on opposite sides of a wall of the subassembly. A prong of the handle is inserted through an opening in the wall to enter a prong receptacle of the leaf spring. A compressible region of the prong receptacle is compressed into a groove formed in the prong of the handle. The leaf spring is attached to a sidewall of the subassembly such that a latching tab extending from a side of the leaf spring projects through an opening in the sidewall.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

The invention features a latch-spring assembly for securing a subassembly within an enclosure and a method for attaching the latch-spring assembly to the subassembly. Economical and easy to install, the latch-spring assembly is amenable to use with spring-loaded and non-spring-loaded subassemblies. The latch-spring assembly of the invention combines a latching mechanism, used to secure a subassembly to an enclosure, with a handle mechanism, used to disengage the latching mechanism and to pull the subassembly from the enclosure.

More specifically, the latch-spring assembly includes a wire form handle joined to a leaf spring. The leaf spring has a latching tab and attaches to an inside surface of a subassembly sidewall, where the leaf spring is generally hidden from view. The handle penetrates a front wall of the subassembly to join the leaf spring. The openings in the front wall through which the handle penetrates are sufficiently small for complying with EMI (electromagnetic interference) requirements.

To join the handle to the leaf spring, in one embodiment, the leaf spring has receptacles (cylindrical portions or barrel rolls) for receiving prongs of the handle. One of the prongs has a groove formed therein. One of the receptacles—the receptacle that is to receive the prong with the groove—has a notch cuts therein to produce a compressible region in that receptacle. The leaf spring has a stop tab for positioning the prong so that the compressible region stops over the groove when the prong that has penetrated the receptacle. Compressing this compressible region into the groove permanently fixes the handle to the leaf spring. The latch-spring assembly is fixed to the subassembly by fastening the leaf spring to a sidewall.

When the latch-spring assembly is attached to the sidewall, the latching tab extends through a corresponding opening in the sidewall. The latching tab engages in a corresponding latch-receiving mechanism on a sidewall of the enclosure within which the subassembly is inserted. The handle has an aesthetic, ergonomic, curved portion for laterally deflecting the leaf spring to disengage the latching tab from the latch-receiving mechanism and for pulling the subassembly out of the enclosure.

Figure 1:
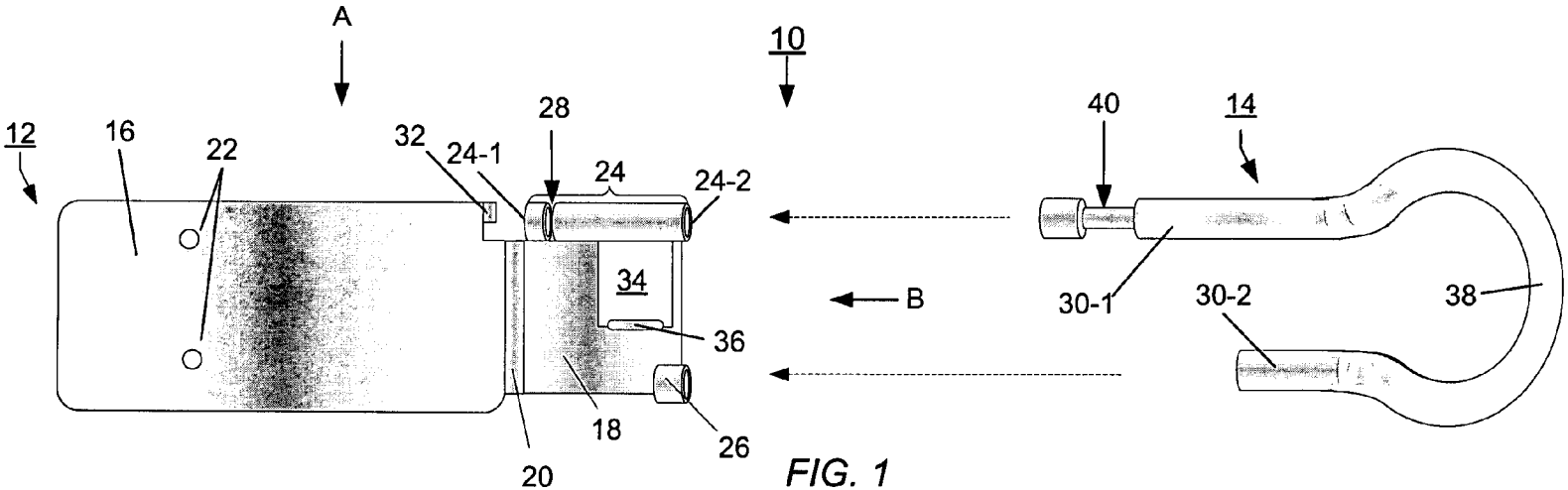
FIG. 1 is an exploded side view of an embodiment of a latch-spring assembly constructed in accordance with the invention, the latch-spring assembly comprising a leaf spring and a wire form handle.

FIG. 1 shows an exploded side view of an embodiment of a latch-spring assembly 10 of the present invention. The latch-spring assembly 10 includes a leaf spring 12 and wire form handle 14. The leaf spring 12 is formed from a spring material, e.g., stainless steel, which deflects by bending when a force acts upon the material. The leaf spring 12 has a first (anchor) section 16 and a second (spring) section 18, joined together by a curved section 20. In one embodiment, construction of the leaf spring 12 is from a rectangular-shaped integral piece of sheet metal, approximately 2¾ inches in length. The first section 16 is substantially planar with a pair of openings 22 formed therein through which fasteners (e.g., rivets) may pass to secure the leaf spring 12 to a subassembly sidewall. The second section 18 is substantially planar in shape and non-coplanar with respect to the first section 16 because of the curved section 20 joining the first and second sections 16, 18. It is to be understood that the curved section 20 in the leaf spring 12 is an optional feature. In other embodiments, the first and second sections 16, 18 are co-planar, without a curved section 20 therebetween.

The second section 18 has a first cylindrical portion 24 at one edge thereof and a second cylindrical portion 26 at another edge thereof. Each cylindrical portion 24, 26 has a bore extending completely therethrough such that both ends of each cylindrical portion 24, 26 are open. The cylindrical portions 24, 26 are substantially parallel to each other. In one embodiment, the cylindrical portion 24 has a longer length than the cylindrical portion 26. Alternatively, the cylindrical portions 24, 26 can be equal in length or the cylindrical portion 26 can be longer than the cylindrical portion 24.

The first cylindrical portion 24 also has a notch 28 formed therein. The notch 28 partitions the first cylindrical portion 24 into two sections, a smaller section 24-1 and a larger section 24-2. The smaller section 24-1 defines a compressible region of the cylindrical portion 24.

The diameters of the bores of the cylindrical portions 24, 26 are sized to receive prongs 30-1, 30-2 (generally, 30) of the wire form handle 14. Projecting from an edge of the first section 16, substantially perpendicular to the plane of the first section 16, is a stop tab 32. The stop tab 32 is disposed adjacent to an open end of the first cylindrical portion 24, in a path of the prong 30-1 that extends through the first cylindrical portion 24. Although shown in FIG. 1 to be associated with the first cylindrical portion 24, the stop tab 32 and notch 28 can alternatively both be associated with the second cylindrical portion 26, or the stop tab 32 can be associated with one of the cylindrical portions and the notch 28 with the other of the cylindrical portions. Alternatively, both cylindrical portions can have a notch and an associated stop tab.

The second section 18 also has an opening 34 formed therein. Projecting from an edge of the opening 34—in FIG. 1, from the lower edge—is a latching tab 36. The latching tab 36 extends substantially perpendicularly from one side of the second section 18, i.e., from the side opposite of the cylindrical portions.

Formed from wire stock, e.g., of stainless steel or carbon steel, the handle 14 includes a curved portion 38 and the two substantially parallel, straight prongs 30 that extend from the curved portion 38. The size of the curved portion 38 is such that an individual can hook a finger therethrough, to pull on the handle 14 when drawing the subassembly out of an enclosure. The lengths of the prongs 30 are approximately equal to or longer than the lengths of the bores extending through the cylindrical portions 24, 26. Although FIG. 1 shows the handle 14 to have one prong that is longer than the other prong, the prongs 30 can be equal in length to each other (and the corresponding cylindrical portions can be equal in length to each other for receiving a respective prong).

One of the prongs 30-1 has a groove 40 formed therein, that is, the groove 40 is a section of the prong with a smaller thickness or diameter than the diameter of the prong 30-1 on either side of the groove 40. The width of the groove 40 is wider than the width of the compressible region 24-1 of the first cylindrical portion 24. Although only prong 30-1 is shown to have a groove, either or both prongs 30-1, 30-2 can have a groove in the practice of the invention. In one embodiment, the length of the handle 14, measured from one end of the prong 30 to the tip of the curved portion 38, is approximately 2¾ inches.

Figure 2:
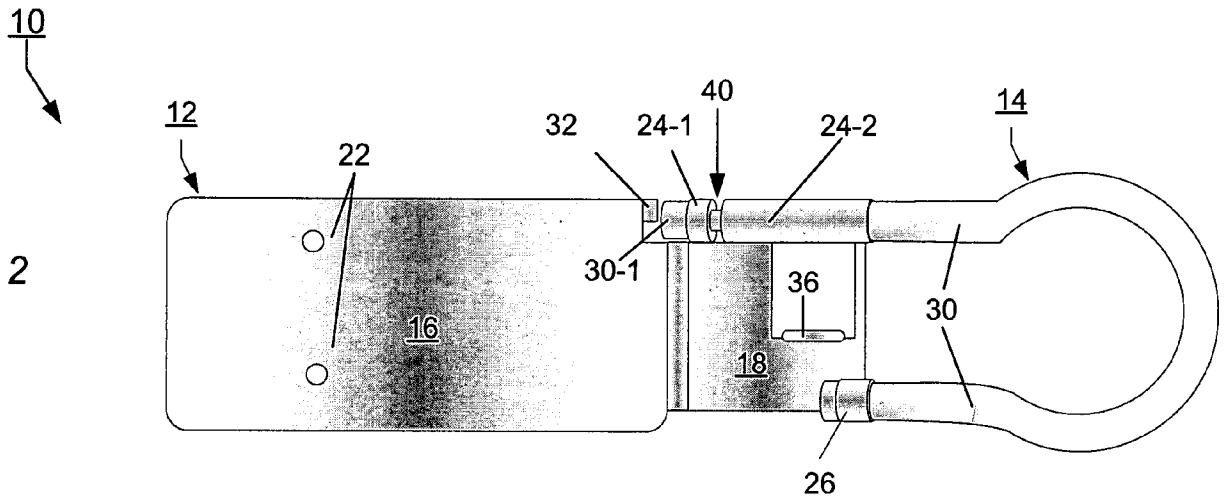
FIG. 2 is a side view of the latch-spring assembly with the leaf spring joined to the wire form handle.

FIG. 2 shows a side view of the latch-spring assembly 10, in which the wire form handle 14 joins the leaf spring 12. As shown, the prong 30-1 extends through the bore of the first cylindrical portion 24 and abuts the stop tab 32. The stop tab 32 limits the extent to which the prongs 30 of the wire form handle 14 can slide through the respective cylindrical portions 24, 26. When the probe 30-1 abuts the stop tab 32, the smaller section 24-1, (hereafter, compressible region), of the first cylindrical portion 24 encircles the groove 40 on the probe 30-1. The other prong 30-2 extends through the bore of the second cylindrical portion 26.

Figure 3:
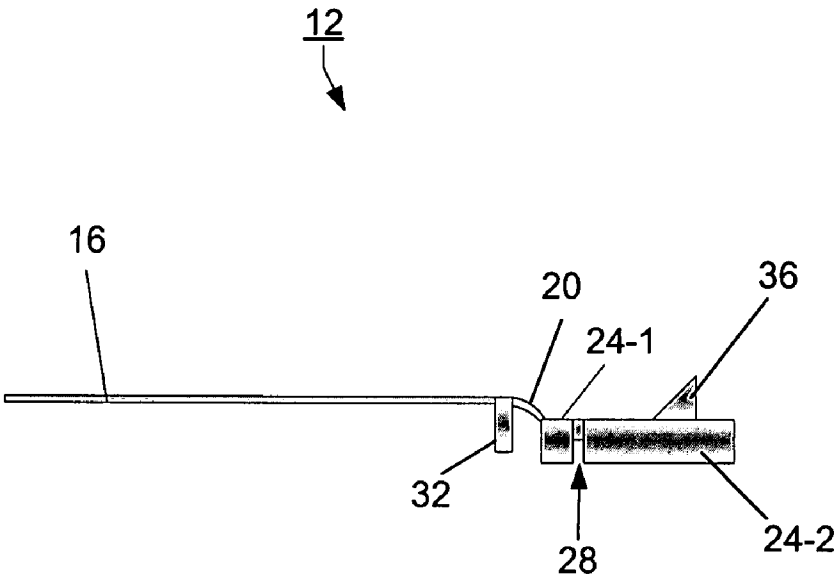
FIG. 3 is a top view of the leaf spring of FIG. 1.
Figure 5:
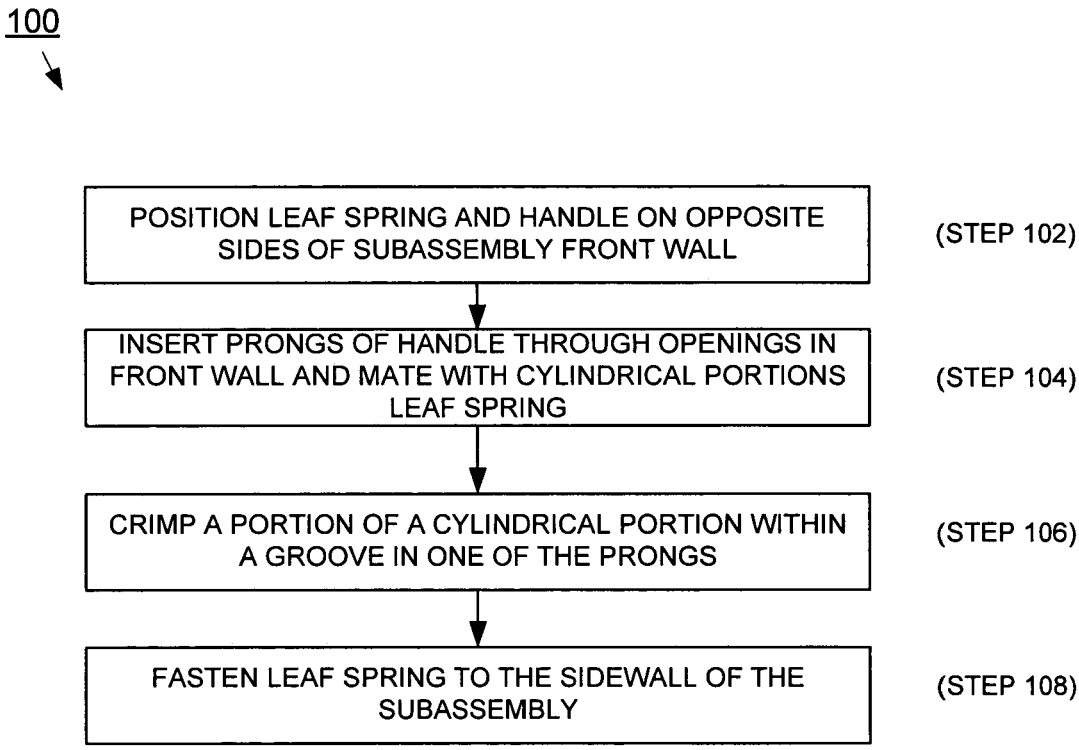
FIG. 5 is a flow diagram of an embodiment of a process for installing a latch-spring assembly to a sidewall of a subassembly.

FIG. 3 shows a top view—from the direction of arrow A in FIG. 1—of the leaf spring 12. The latching tab 36 projects substantially perpendicularly from one side of the second section 18. In one embodiment, the latching tab 36 has a shape like a right triangle, with its hypotenuse facing toward the first section 16 of the leaf spring 12. Also shown is the stop tab 32 projecting from the first section 16.

Figure 4:
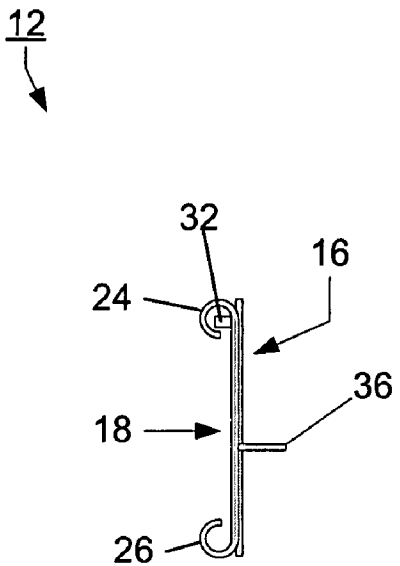
FIG. 4 is an end view of the leaf spring of FIG. 1, with a latching tab projecting from one side of the leaf spring.

FIG. 4 shows an end view of the leaf spring 12 from the direction of arrow B in FIG. 1. The end view shows the bores through the cylindrical portions 24, 26 and the stop tab 32 at the far end of the bore of the cylindrical portion 24. In addition, the end view illustrates the non-coplanar alignment of the first and second sections, 16, 18 of the leaf spring 12.

FIG. 5 and FIGS. 6A-6D illustrate an embodiment of a process 100 for assembling and attaching a latch-spring assembly to a sidewall of a subassembly 60. This particular latch-spring assembly is adapted for attaching to a left sidewall (as viewed from the direction of arrow C). Similarily attached to the right sidewall of the subassembly 60 is a second latch-spring assembly (not shown)—the latch-spring assembly 10 shown in FIGS. 1-4 is adapted for attaching to a right sidewall.

Figure 6A:
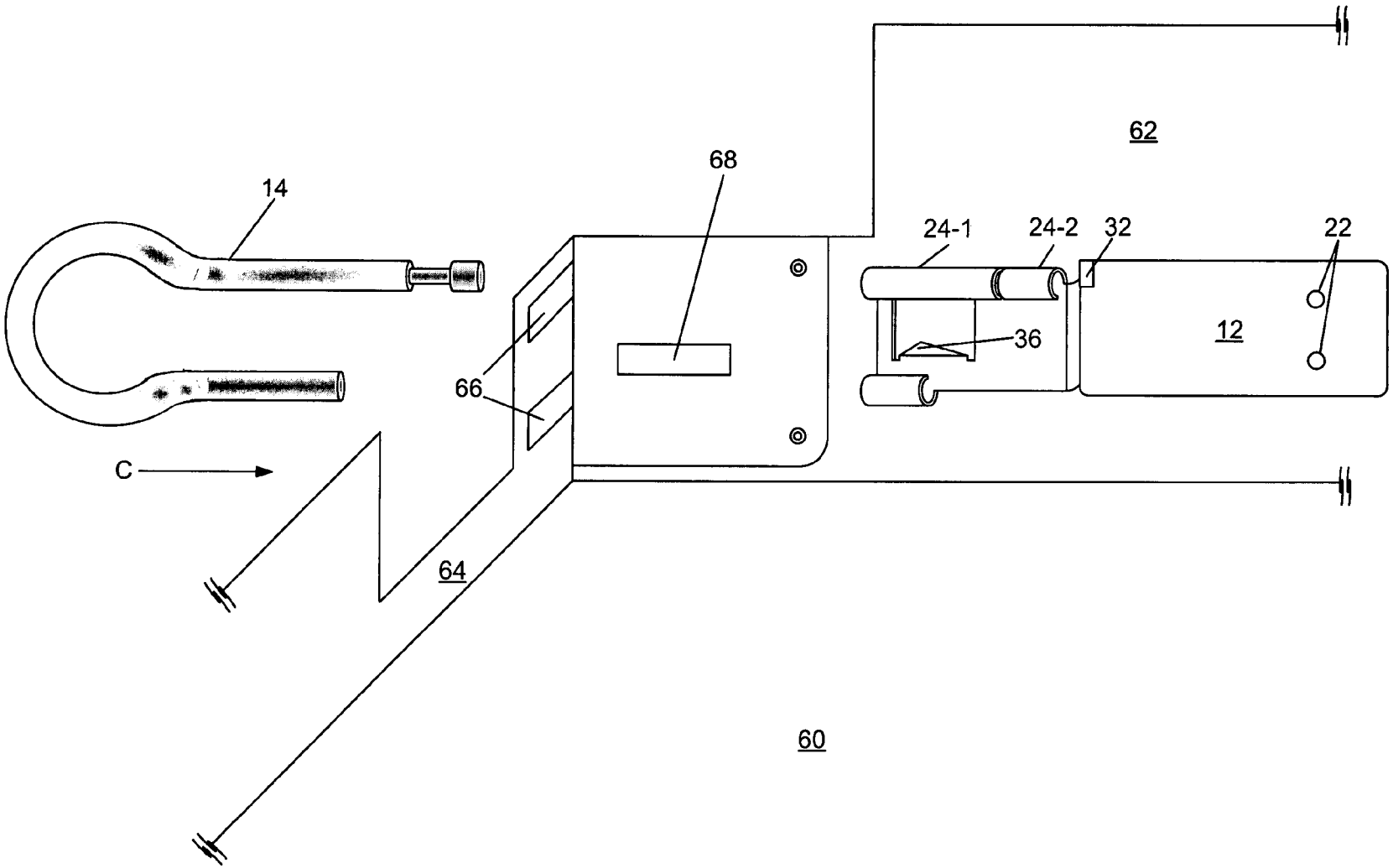
FIG. 6A shows the handle and leaf spring positioned on opposite sides of a subassembly wall.

At step 102, the leaf spring 12 and handle 14 are positioned on opposite sides of a front wall 64 of the subassembly 60, as shown in FIG. 6A, so that the prongs 30 of the handle 14 and the open ends of the cylindrical portions 24, 26 face the front wall 64. The front wall 64 has a pair of openings 66-1, 66-2 (generally, 66) for receiving the prongs 30-1, 30-2. The size and shape of the openings 66 are designed to receive the prongs 30 and to permit lateral deflection of the handle 14, as described in more detail below. The sidewall 62 has a latch opening 68 for receiving the latching tab 36 of the handle 14.

Figure 6B:
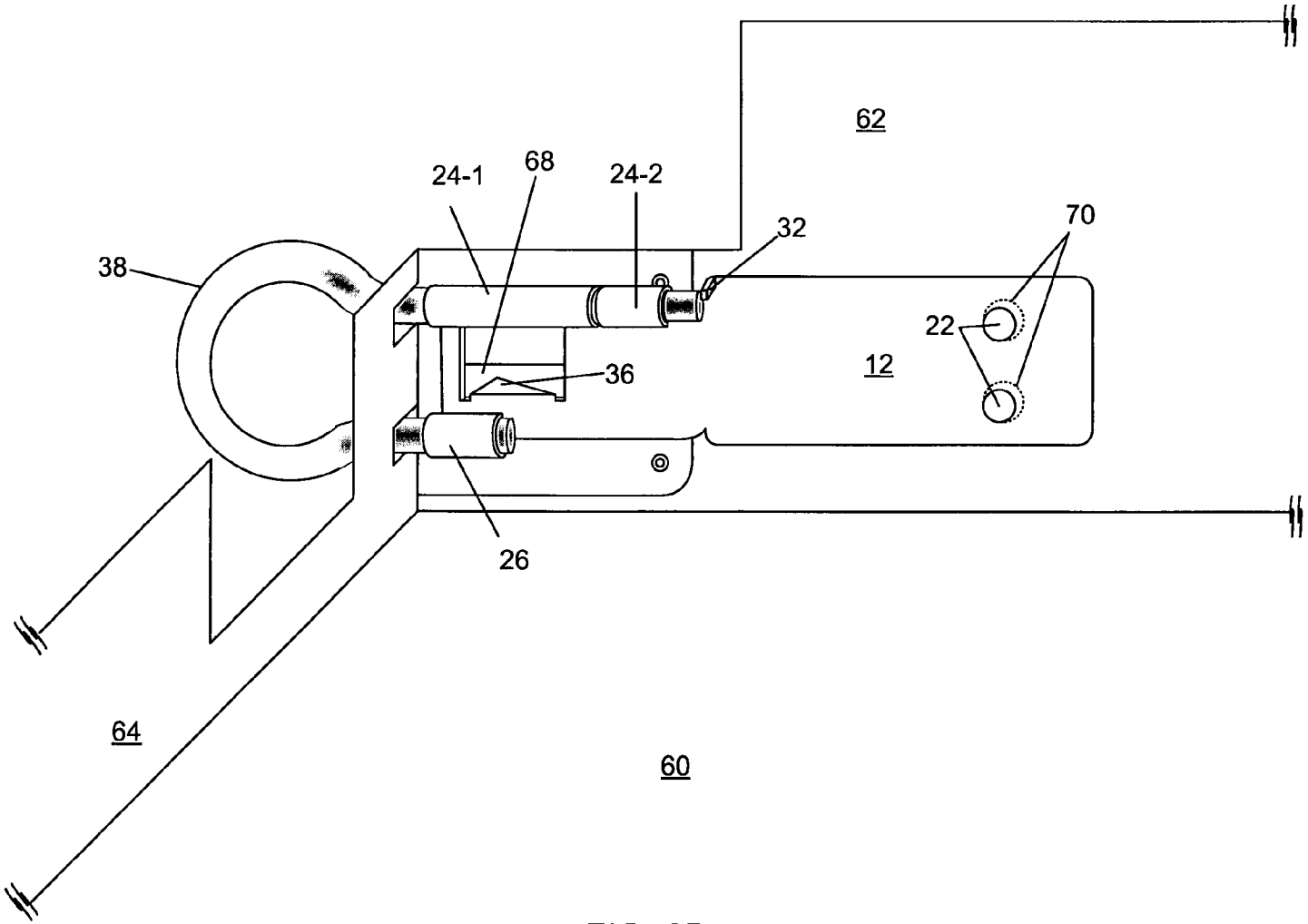
FIG. 6B shows the handle passing through an opening in the wall to engage leaf spring.

At step 104, from the outside of the subassembly 60, the prongs 30 of the handle 14 are inserted through the openings 66 in the front wall 64, and into the open ends of the corresponding cylindrical portions 24, 26 of the leaf spring 12, until the probe 30-1 reaches the stop tab 32, which prevents further insertion of the prongs 30. As shown in FIG. 6B, the latching tab 36 of the leaf spring 12 enters the latch opening 68 in the subassembly sidewall 62. In addition, the openings 22 in the first section 16 of the leaf spring 12 align with openings 70 in the subassembly sidewall 62.

Figure 6C:
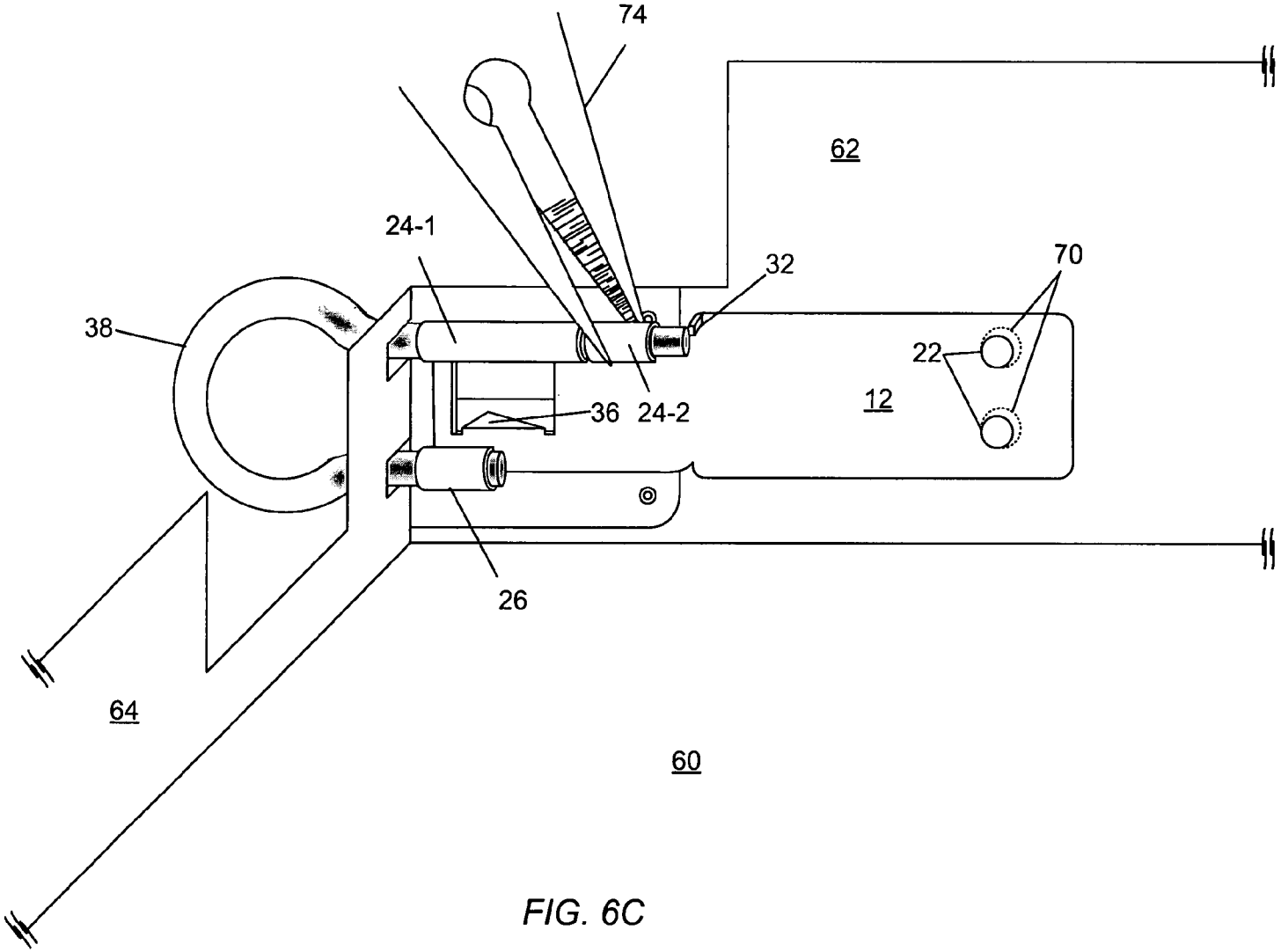
FIG. 6C shows the handle being permanently attached to the leaf spring.

When the probe 30-1 reaches the stop tab 32, the compressible region 24-1 of the first cylindrical portion 24 encircles the groove 40 on the probe 30-1. Using a crimping tool 74, such as pliers, a technician crimps (step 106) the compressible region 24-1 into the groove 40. This permanently joins the handle 14 to the leaf spring 12, as shown in FIG. 6C, because the crimped portion within the groove 40 restricts movement of the probe 30-1 within the cylindrical portion 24.

Figure 6D:
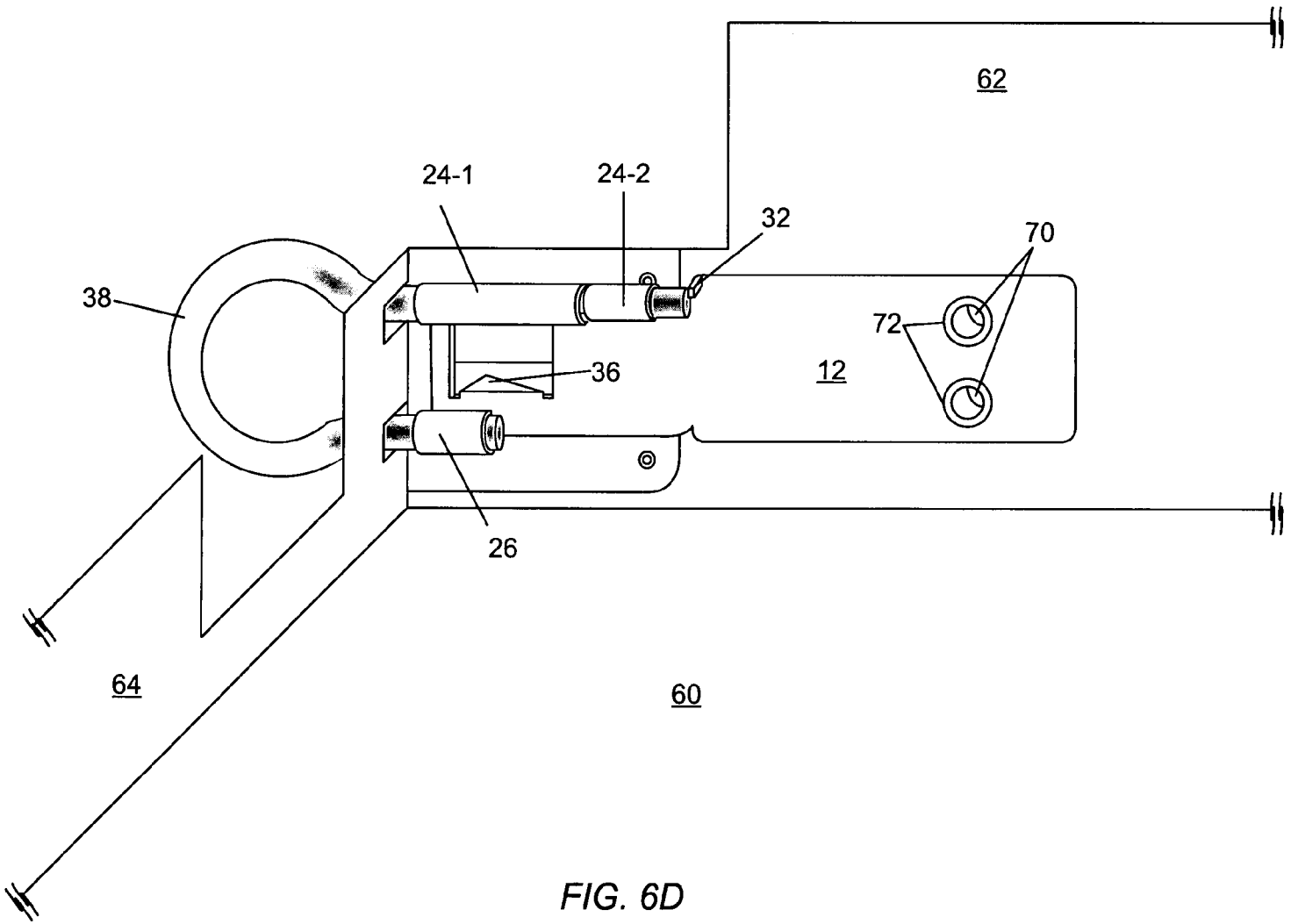
FIG. 6D shows the leaf spring mounted to a sidewall of the subassembly.

At step 108, the technician attaches the leaf spring 12 by inserting fasteners 72 (e.g., rivets) into the openings 22 of the leaf spring to secure the first section 16 to the subassembly sidewall 62, as shown in FIG. 6D. Once secured thus, the first section 16 lies flush against the subassembly sidewall 62, whereas the second section 18 is spaced apart from the subassembly sidewall 62 because the curved section 20 joining the first and second sections 16, 18 bends away from the sidewall 62. (Both the first and second sections 16, 18 lie flush against the subassembly sidewall for those embodiments in which the first and second sections 16, 18 are coplanar, i.e., do not have a curved section 20 therebetween). Anchored to the subassembly sidewall 62 by way of the first section 16, the second section 18 is able to deflect laterally away from the sidewall 62.

Figure 7:
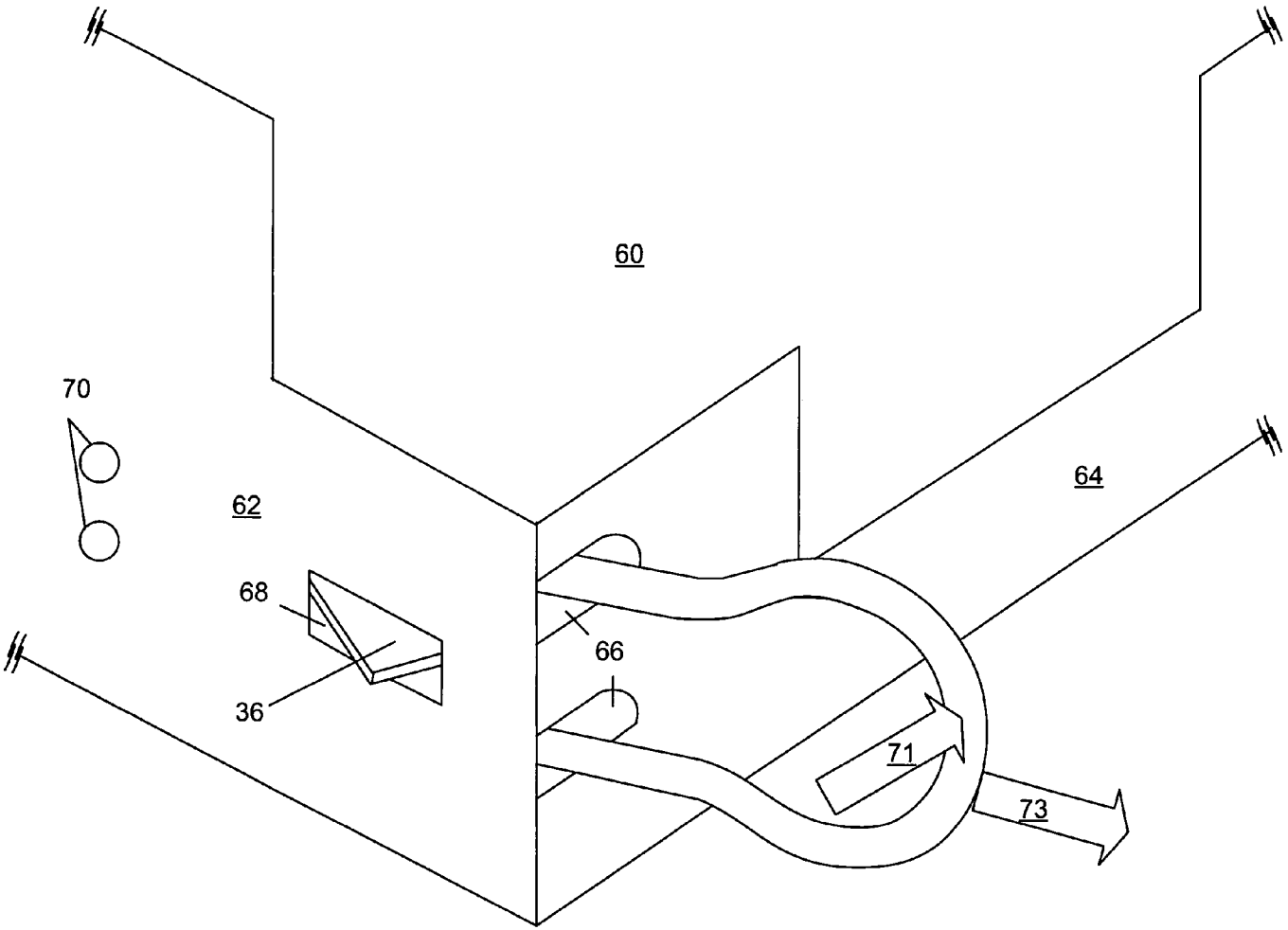
FIG. 7 is an isometric view of the subassembly with an installed latch-spring assembly.

FIG. 7 shows the latch-spring assembly 10' after being installed in the subassembly 60. The handle 14 of the latch-spring assembly 10 projects through the openings 66 in the front wall 64. The latching tab 36 of the leaf spring (not shown) extends through the latch opening 68 in the sidewall 62 of the subassembly 60.

When a technician slides the subassembly 60 into an enclosure (not shown)—with the subassembly closely fitting within the enclosure—the sidewalls of the enclosure press against the sloped edges of the latching tabs 36 (one on each subassembly sidewall). Consequently, the leaf springs 12 bend laterally away from the enclosure sidewalls until the latching tabs 36 arrive at corresponding latch-receiving mechanisms on the enclosure sidewalls. Latch-receiving mechanisms can vary, for example, a depression in the enclosure sidewall or a raised or depressed vertical edge against which the straight back edge of the latching tab catches. Then the leaf springs 12 approximately return to their original (i.e., unbent) shape, with the latching tabs 36 becoming securely engaged with the latch-receiving mechanisms.

To remove the subassembly 60 from the enclosure, an individual deflects the handles 14 inwards (arrow 71) to deflect the leaf springs 12 away from the subassembly sidewalls, thus disengaging each latching tab 36 from its respective latch-receiving mechanism of the enclosure. When the latching tabs 36 become disengaged, the technician can then draw the subassembly 60 out of the enclosure by inserting his fingers through the curved portions 38 of the handles 14 and pulling (arrow 73).

The advantages of the latch-spring assembly include (1) an individual has a relatively large handle with which to grasp and pull out the subassembly 60 from an enclosure, (2) the size of the openings in the front wall 64 are large enough to receive the prongs 30, yet sufficiently small to satisfy EMI/RFI requirements, and (3) crimping is amenable to tight quarters.

While the invention has been shown and described with reference to specific preferred embodiments, it should be understood by those skilled in the art that various changes in form and detail may be made therein without departing from the spirit and scope of the invention as defined by the following claims. For example, the handle can be made of other materials other than wire stock (e.g., plastic).

What is claimed is:

1. An apparatus, comprising:

a handle having a grip portion and a prong extending from the grip portion, the prong having an end and a groove formed near the end;

a leaf spring having a latching tab extending from a side thereof and a prong receptacle with a bore extending therethrough that closely receives the prong of the handle, the prong receptacle having a compressible region; and an assembly with a front wall and a sidewall extending substantially perpendicularly from the front wall, the front wall having a prong opening formed therein, the sidewall having a latch opening, wherein the prong of the handle passes through the prong opening in the front wall to enter the prong receptacle, the leaf spring is mounted to the sidewall such that the latching tab enters the latch opening in the sidewall, and the compressible region of the prong receptacle is compressed within the groove of the prong to secure the handle to the leaf spring.

2. The apparatus of claim 1, further comprising a stop tab disposed adjacent an open end of the prong receptacle to limit an extent of penetration of the prong into the prong receptacle.

3. The apparatus of claim 1, wherein the leaf spring is made of an integral piece of material.

4. The apparatus of claim 1, wherein the handle is constructed of wire stock.

5. The apparatus of claim 1, wherein the prong opening in the front wall has a shape that permits lateral deflection of the handle.

6. An apparatus, comprising:

a handle having first and second prongs extending approximately parallel to each other from a finger-grip portion, the first prong having an end and a groove formed near the end;

a leaf spring having an anchor portion for securing the leaf spring to a surface of a sidewall of a subassembly and a spring portion flexibly coupled at one end of the anchor portion, the spring portion having a first side with a planar latching tab extending generally perpendicularly therefrom for latching the spring portion to the sidewall, the spring portion having a second side opposite the first side with a first receptacle closely receiving the first prong of the handle and a second receptacle closely receiving the second prong of the handle, the first receptacle having a compressible region, wherein the compressible region is compressed within the groove of the first prong to secure the handle to the leaf spring.

7. The apparatus of claim 6, further comprising a stop tab disposed adjacent to an open end of the first prong receptacle to limit an extent of penetration of the first prong into the first prong receptacle.

8. The apparatus of claim 7, wherein the leaf spring is made of an integral piece of material.

9. The apparatus of claim 6, wherein the handle is constructed of wire stock.

10. The apparatus of claim 6, further comprising the subassembly with a front wall and the sidewall extending substantially perpendicularly from the front wall, the front wall having a plurality of prong openings formed therein, the sidewall having a latch opening, wherein each prong of the handle passes through one of the prong openings in the front wall to enter one of the receptacles and the leaf spring is mounted to the sidewall such that the latching tab enters the latch opening in the sidewall.

11. The apparatus of claim 10, wherein each prong opening in the front wall has a shape that permits lateral deflection of the handle.

12. A method for attaching a latch-spring assembly to a subassembly, comprising:

positioning a handle and a leaf spring on opposite sides of a wall of the subassembly;

inserting a prong of the handle through an opening in the wall to enter a prong receptacle of the leaf spring;

compressing a compressible region of the prong receptacle into a groove formed in the prong of the handle; and attaching the leaf spring to a sidewall of the subassembly such that a latching tab extending from a side of the leaf spring projects through an opening in the sidewall.

13. The method of claim 12, wherein the leaf spring includes a stop tab disposed adjacent an open end of the prong receptacle and the step of inserting includes inserting the prong into the prong receptacle until the prong reaches the stop tab.

14. The method of claim 13, further comprising forming the leaf spring using an integral piece of material.

15. The method of claim 12, further comprising constructing the handle of wire stock.

16. The method of claim 12, further comprising the step of inserting the subassembly into an enclosure such that the latching tab engages a latch-receiving mechanism in a sidewall of the enclosure, to secure the subassembly to the enclosure.

17. The method of claim 16, further comprising the step of deflecting the handle laterally to disengage the latching tab from the latch-receiving mechanism of the enclosure, to release the subassembly from the enclosure.

* * * * *